US008833902B2

(12) United States Patent
Sato et al.

(10) Patent No.: US 8,833,902 B2
(45) Date of Patent: Sep. 16, 2014

(54) RECORDING APPARATUS

(75) Inventors: Takaya Sato, Kawasaki (JP); Yuji Kanome, Yokohama (JP); Hiroyuki Tanaka, Kawasaki (JP); Yoshiaki Suzuki, Nagareyama (JP); Masahiro Sugimoto, Yokohama (JP); Seiji Suzuki, Ebina (JP); Susumu Hirosawa, Tokyo (JP); Takeaki Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 12/941,914

(22) Filed: Nov. 8, 2010

(65) Prior Publication Data

US 2011/0109691 A1 May 12, 2011

(30) Foreign Application Priority Data

Nov. 10, 2009 (JP) ..... 2009-257419

(51) Int. Cl.
*B41J 2/165* (2006.01)

(52) U.S. Cl.
CPC ..... *B41J 2/16585* (2013.01); *B41J 2/16538* (2013.01)
USPC ..... 347/33

(58) Field of Classification Search
None
See application file for complete search history.

(56) References Cited

U.S. PATENT DOCUMENTS

| | | | | |
|---|---|---|---|---|
| 5,500,660 | A * | 3/1996 | Childers et al. | 347/33 |
| 2005/0062796 | A1 * | 3/2005 | Mott et al. | 347/33 |
| 2007/0159508 | A1 | 7/2007 | Yamamoto | |
| 2008/0007592 | A1 | 1/2008 | Watanabe | |

FOREIGN PATENT DOCUMENTS

| | | | |
|---|---|---|---|
| EP | 1518689 | A1 | 3/2005 |
| JP | 08-001954A | A | 1/1996 |
| JP | 2004-167928 | A | 6/2004 |

* cited by examiner

*Primary Examiner* — Alejandro Valencia
(74) *Attorney, Agent, or Firm* — Canon USA, Inc., IP Division

(57) ABSTRACT

An apparatus includes a recording head having a sealing portion arranged in proximity to nozzle arrays and protruding beyond a nozzle surface. A wiper unit configured to wipe the nozzle surface of the recording head has a first wiper blade and a second wiper blade, and the first wiper blade is arranged to be inclined by an angle θ1 (θ1>0) with respect to a direction orthogonal to the wiping direction within a plane parallel to the nozzle surface, while the second wiper blade is arranged to be inclined by an angle θ2 (θ2<0) with respect to the direction orthogonal to the wiping direction within the plane.

24 Claims, 15 Drawing Sheets

RECORDING APPARATUS

BACKGROUND OF THE INVENTION

1. Field of the Invention

The present invention relates to an inkjet type recording apparatus using a line type recording head.

2. Description of the Related Art

In an inkjet type recording apparatus, it can happen that the ink within the head nozzles is dried and increases its viscosity to be solidified. Further, in some cases, paper powder, dust, bubbles, etc. may get mixed with the ink in the nozzles, which leads to defective ink ejection due to clogging, resulting in deterioration in recording quality. Thus, it is necessary to perform cleaning on the recording head.

US 2008/0007592 discusses a cleaning mechanism which performs wiping with a wiper blade inclined non-parallel to the direction in which the nozzle array is formed. By inclining the wiper blade, the ink scraped off from the nozzle surface is gathered at one end portion and the gathered ink is wiped off by another wiper.

As shown in FIG. 5A, a nozzle chip 20 constituting a recording head has a nozzle surface 22 having a plurality of nozzle arrays for ejecting ink, and a nozzle substrate in which energy elements formed in correspondence with the nozzles are embedded. Further, the nozzle chip 20 has a base substrate 24 having wiring electrically connected to the nozzle substrate. An electrical connection portion between the nozzle substrate and the base substrate 24 is covered with a sealing portion 23 consisting of a resin material, and is protected against corrosion and disconnection. As shown in FIG. 5B, which is an enlarged view, when the nozzle surface 22 is seen sideways, the resin material of the sealing portion 23 is swollen beyond the nozzle surface 22, thus constituting a protrusion protruding from the nozzle surface in the ink ejecting direction. On one nozzle chip 20, there are provided two sealing portions 23 in the vicinity of both ends of the nozzle surface 22 with respect to the direction in which the nozzle arrays are formed.

If wiping is performed on the recording head of this construction, which has the sealing portions 23 swollen higher than the nozzle surface 22, by using the wiper blade as discussed in US 2008/007592, the following problem occurs.

Since the wiper blade is obliquely inclined, an end portion of the wiper blade first passes the nozzle surface 22 to reach the sealing portion 23. Depending upon the inclination angle of the wiper blade, the forward portion thereof may climb onto the sealing portion 23 while the remaining portion thereof is wiping the nozzle arrays. Then, the wiper blade as a whole is raised, and the intimate contact between the portion opposing the nozzle arrays and the nozzle arrays becomes rather insufficient, making it impossible to perform proper wiping on the nozzles.

SUMMARY OF THE INVENTION

The present invention is directed to realization of a cleaning function that makes it possible to reliably perform wiping on a nozzle surface of a recording apparatus in which a plurality of nozzle arrays are formed.

According to an aspect of the present invention, a apparatus includes a recording head having a nozzle surface having a plurality of nozzle arrays arranged in parallel, and a sealing portion arranged in proximity to the plurality of nozzle arrays and protruding beyond the nozzle surface, and a wiper unit capable of relatively moving with respect to the nozzle surface in a wiping direction parallel to the nozzle surface and configured to wipe the nozzle surface, wherein the wiper unit has a first wiper blade and a second wiper blade, the first wiper blade is arranged to be inclined by an angle $\theta 1$ ($\theta 1>0$) with respect to a direction orthogonal to the wiping direction within a plane parallel to the nozzle surface, and wherein the second wiper blade is arranged to be inclined by an angle $\theta 2$ ($\theta 2<0$) with respect to the direction orthogonal to the wiping direction within the plane.

According to the present invention, a recording apparatus equipped with a wiper unit capable of more reliably wiping a nozzle surface having a plurality of nozzle arrays is realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
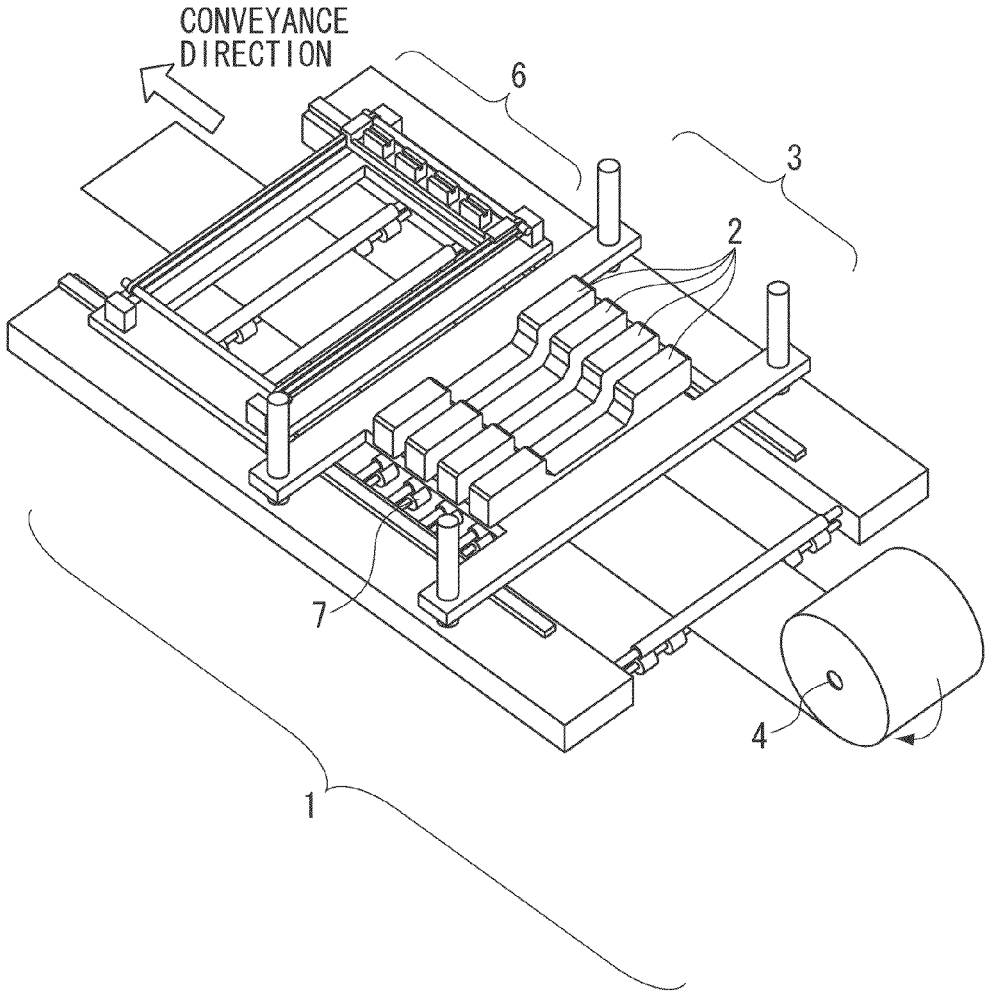
FIG. 1 is a perspective view of a main portion of a recording apparatus according to an exemplary embodiment of the present invention.
Figure 2:
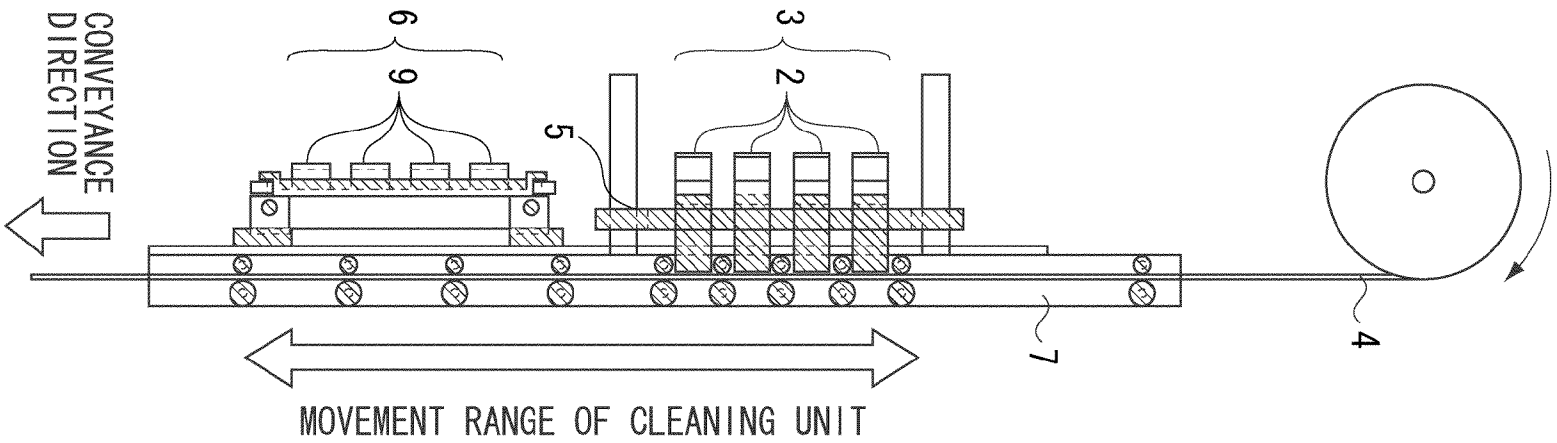
FIG. 2 is a sectional view of the main portion of the recording apparatus.
Figure 3:
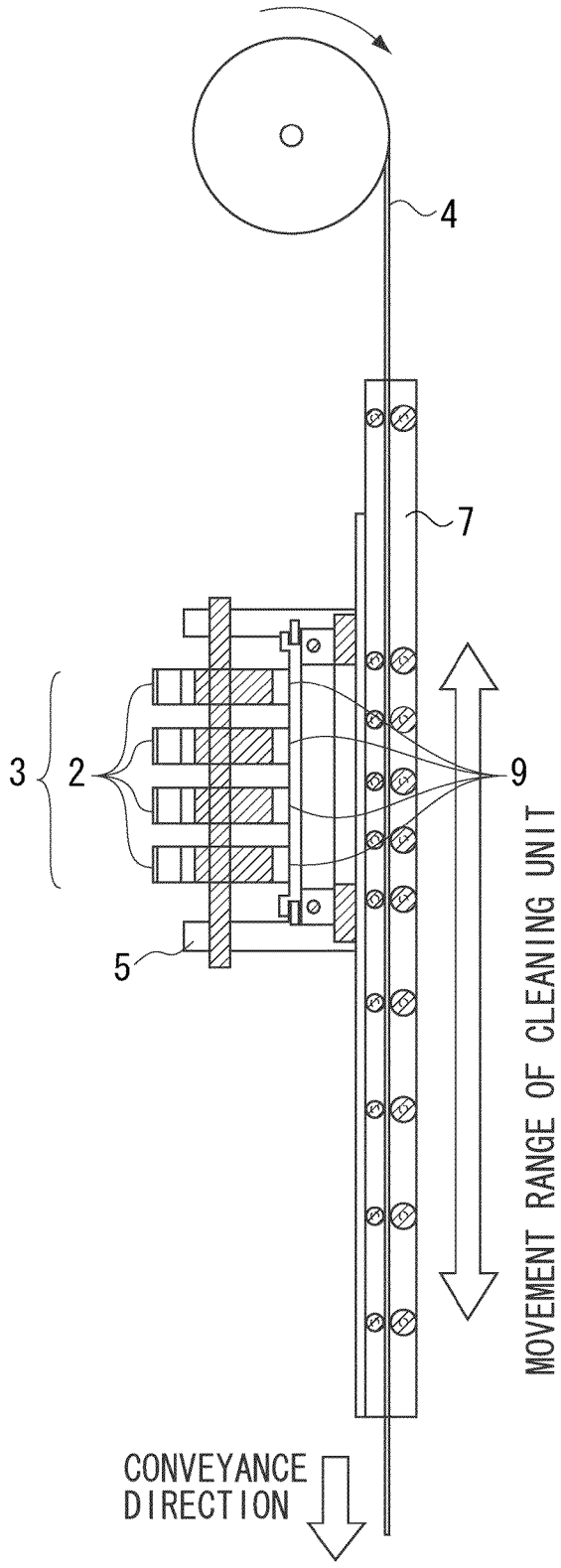
FIG. 3 is a perspective view illustrating a condition during cleaning operation.

Specific exemplary embodiments of the present invention will be described with reference to the drawings. FIG. 1 is a perspective view illustrating the construction of a main portion around a recording unit of a recording apparatus according to an exemplary embodiment, and FIG. 2 is a sectional view illustrating the structure of the main portion shown in FIG. 1. FIG. 3 is a sectional view illustrating the condition during cleaning operation.

A recording apparatus 1 according to the present exemplary embodiment is a line printer adapted to perform printing equipped with an elongated line head and adapted to perform printing while continuously conveying a sheet in a conveyance direction (first direction). It is equipped with a holder retaining a sheet 4 in the form of a roll, a conveyance mechanism 7 conveying the sheet 4 in the first direction at a predetermined speed, and a recording unit 3 performing recording on the sheet 4 by line heads. The sheet used in the embodiment is not restricted to a continuous roll sheet; it is also possible to adopt cut sheets. The recording apparatus 3 is further equipped with a cleaning unit 6 adapted to perform cleaning on a nozzle surface of a recording head through wiping. Further, there are provided, along the sheet conveyance path, a cutter unit situated on the downstream side of the recording unit 3 and adapted to cut the sheet 4, a drying unit forcibly drying the sheet, and a discharge tray.

The recording unit 3 is equipped with a plurality of recording heads 2 respectively corresponding to inks of different colors. Although this exemplary embodiment uses four recording heads corresponding to the four colors of cyan (C), magenta (M), yellow (Y), and black (K), the number of colors is not restricted to four. The inks of the different colors are respectively supplied to the recording heads 2 via ink tubes. The plurality of recording heads 2 are integrally held by a head holder 5; there is provided a mechanism allowing vertical movement of the head holder 5 so that the distance between the plurality of recording heads 2 and the surface of the sheet 4 can be varied.

The cleaning unit 6 has a plurality of (four) cleaning mechanisms 9 in correspondence with the plurality of (four) recording heads 2. The cleaning unit 6 as a whole can slide in a first direction. FIGS. 1 and 2 show the state during recording, in which the cleaning unit 6 is situated on the downstream side of the recording unit 3 with respect to the sheet conveyance direction. On the other hand, FIG. 3 shows the state during cleaning operation, in which the cleaning unit 6 is situated directly under the recording heads 2 of the recording unit 3. In FIGS. 2 and 3, the movable range for the cleaning unit 6 is indicated by arrows.

Figure 4A:
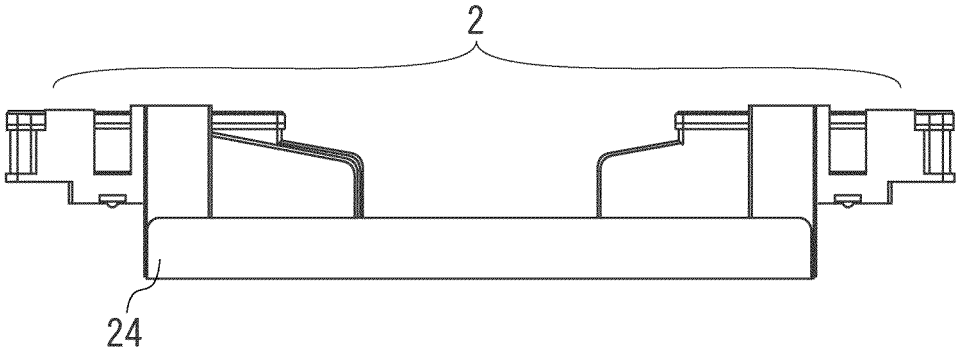
FIGS. 4A and 4B illustrate the structure of a recording head.
Figure 4B:
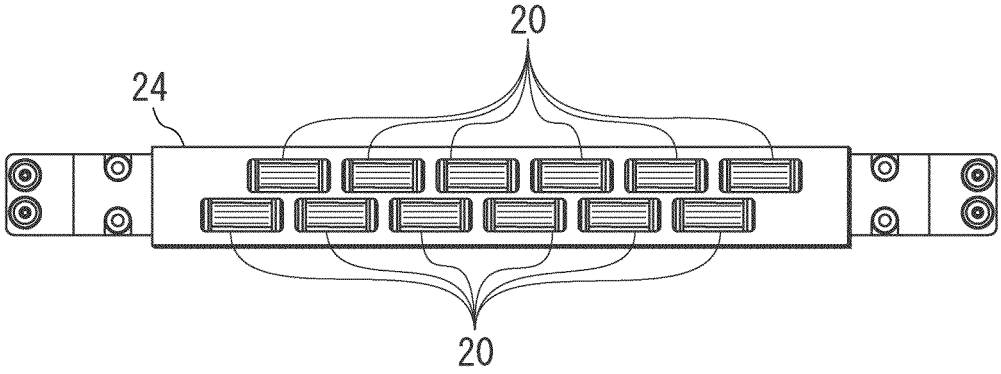

FIGS. 4A and 4B show the structure of one recording head 2. The recording head 2 is a line type recording head in which inkjet type nozzle arrays are formed over a range covering the maximum width of the sheet which may be used. The direction in which the nozzle arrays are arranged is a direction (second direction) orthogonal to the first direction. A plurality of nozzle chips 20 are arranged in the second direction on a large base substrate 24. As shown in FIG. 4B, a plurality of (four, in the present exemplary embodiment) nozzle chips 20 are formed regularly in two rows in a zigzag fashion over the entire range in the width direction. It is also possible for the nozzle chips 20 to be arranged in other regular fashions than the zigzag fashion. As the inkjet system, it is possible to adopt a system using heat generating elements, a system using piezoelectric elements, a system using electrostatic elements, a system using micro-electro-mechanical systems (MEMS) elements, etc.

Figure 5A:
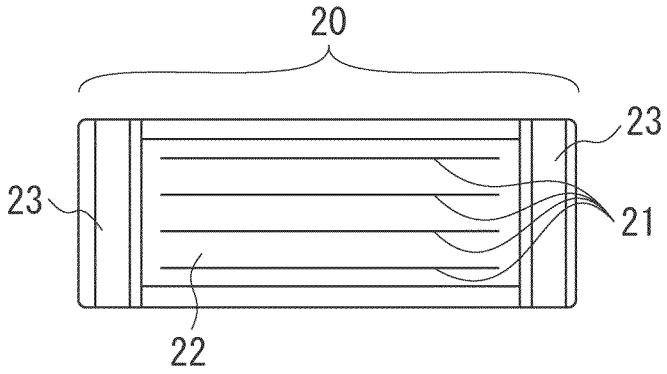
FIGS. 5A and 5B illustrate the structure of a nozzle chip.
Figure 5B:
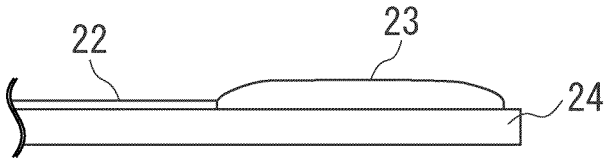

FIGS. 5A and 5B illustrate the structure of one nozzle chip 20 constituting the recording head 2. The nozzle chip 20 is equipped with a nozzle surface 22 having a plurality of nozzle arrays 21 for ejecting ink, and a nozzle substrate in which energy elements formed in correspondence with the nozzles are embedded. The plurality of (four in the present exemplary embodiment) nozzle arrays 21 are arranged in parallel in the first direction. The nozzle substrate of the nozzle chip 20 is provided on a base substrate 24. The nozzle substrate and the base substrate 24 are connected by an electrical connection portion, and the electrical connection portion is covered with a sealing portion 23 consisting of a resin material and is protected against corrosion and disconnection. As shown in FIG. 5B, which is an enlarged view, when the nozzle surface 22 is seen sideways, a sealing portion 23 is formed on the base substrate 24, and constitutes a protrusion protruding beyond the nozzle surface 22 in the ink ejecting direction (third direction). On one nozzle chip 20, there are provided two sealing portions 23 in the vicinity of both ends of the nozzle surface 22 with respect to the nozzle array forming direction (second direction). In this way, the sealing portion 23 is in proximity to the plurality of nozzle arrays 21, and is swollen beyond the nozzle surface 22 in the ink ejecting direction so as to protrude with a gentle step.

Figure 6:
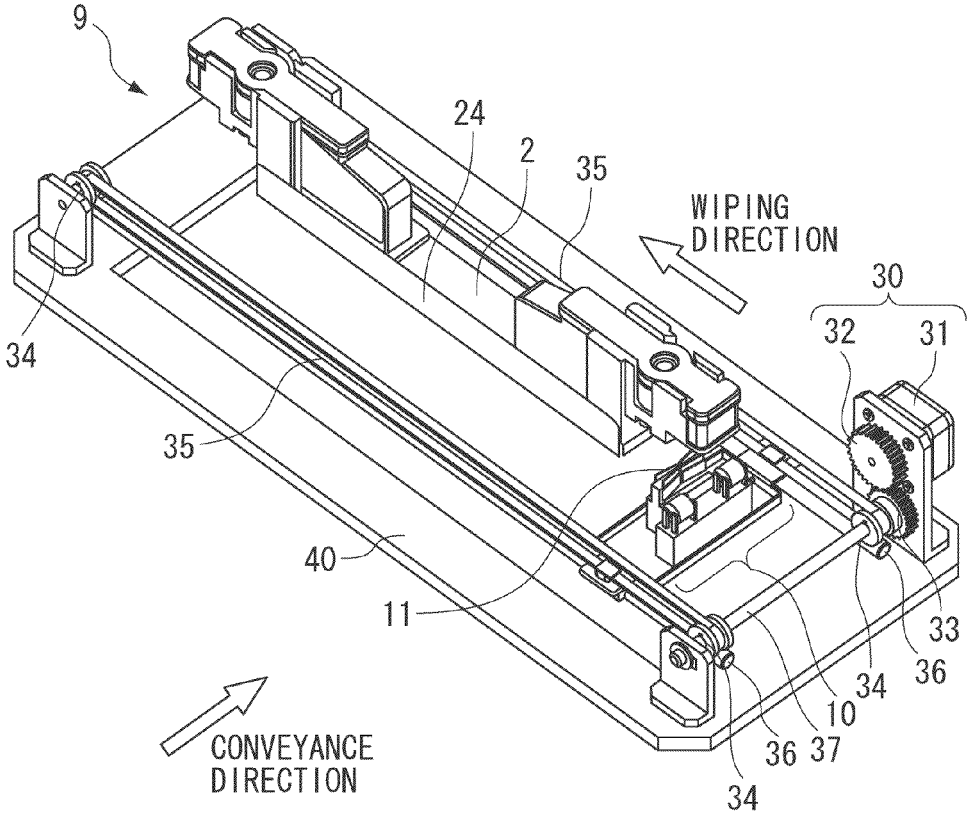
FIG. 6 is a perspective view illustrating the construction of a cleaning mechanism.

FIG. 6 is a perspective view showing in detail the construction of one cleaning mechanism 9. Roughly speaking, the cleaning mechanism 9 has a wiper unit 10 wiping off ink and dust adhering to the nozzle surface 22 of the recording head 2, a drive mechanism moving the wiper unit 10 in the wiping direction (second direction), and a frame 40 integrally supporting them. The wiper unit 10 is a movable unit having one wiper blade, etc. Through driving by a drive source 30, the drive unit moves, in the second direction, the wiper unit 10 guided and supported by two shafts 36. The drive source 30 has a drive motor 31 and speed reduction gears 32 and 33, and is adapted to rotate a drive shaft 37. The rotation of the drive shaft 37 is transmitted by pulleys 34 and belts 35 to move the wiper unit 10.

Figure 7A:
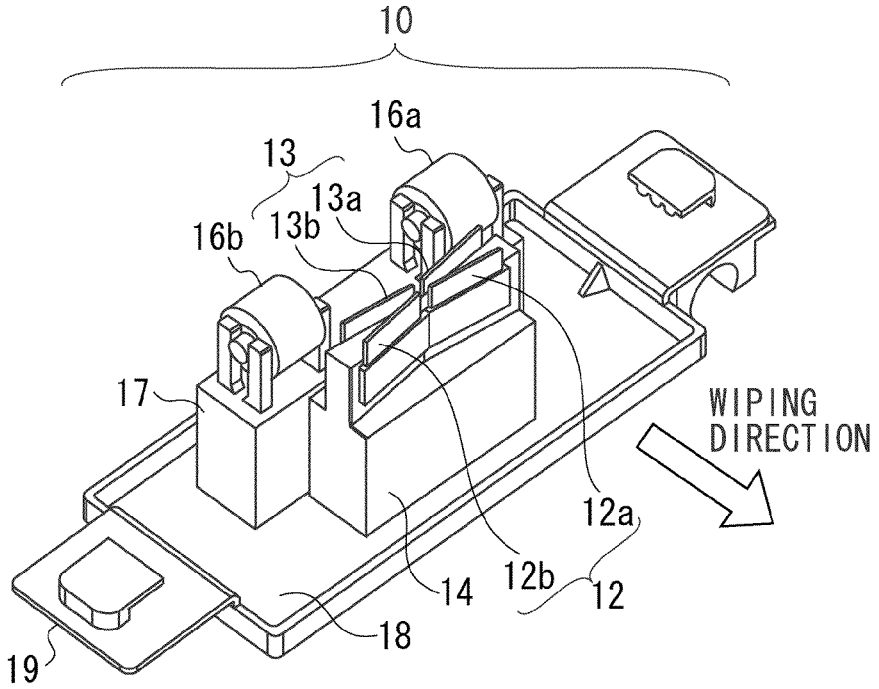
FIGS. 7A and 7B illustrate the construction of a wiper unit.
Figure 7B:
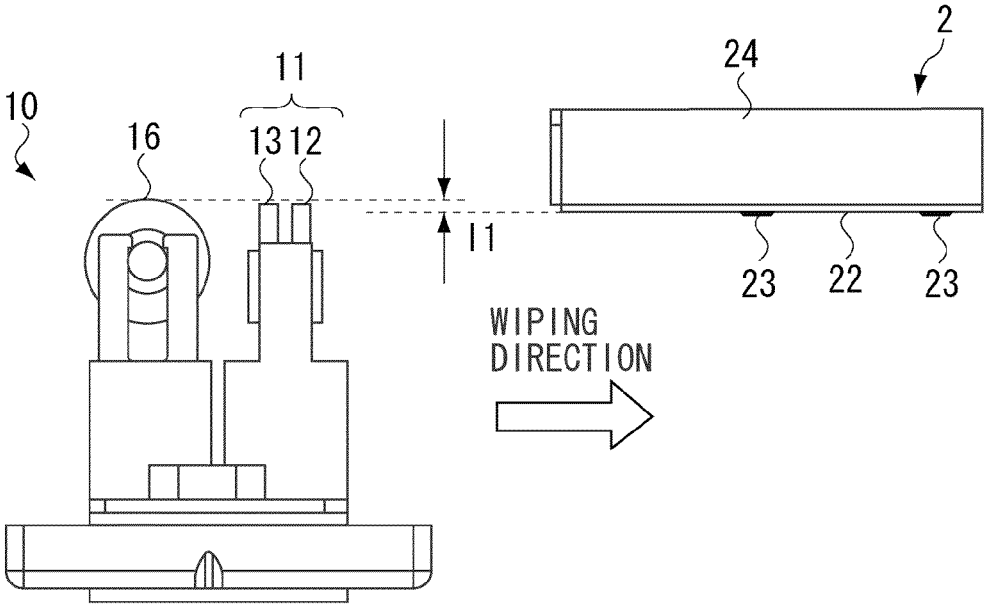

FIGS. 7A and 7B illustrate in detail the construction of the wiper unit 10. FIG. 7A is a perspective view of the unit. The wiper unit 10 is equipped with two first wiper blades 12 (12*a* and 12*b*), two second wiper blades 13 (13*a* and 13*b*), and a blade holder 14 supporting them integrally. Further, the wiper unit 10 is equipped with two ink absorbing members 16*a* and 16*b* and an absorbing member holder 17 supporting them. The blade holder 14 and the absorbing member holder 17 are mounted on a unit base 18.

The ink absorbing members 16*a* and 16*b* are rollers formed of a porous material of high absorptivity and adapted to be driven to rotate. The ink absorbing members 16 are provided so as to be in contact with the nozzle surface 22 at two positions corresponding to both ends of the wiper blade 11. After the wiping by the wiper blade 11, ink and dust overflowing from both ends of the wiper blade 11 and remaining on the nozzle surface 22 are absorbed and recovered by the ink absorbing members 16*a* and 16*b*.

FIG. 7B is a side view of the unit, showing also the positional relationship between the wiper unit 10 and the recording head 2. The wiper blade 11 consists of the first wiper blade 12 and the second wiper blade 13 put together. The first wiper blade 12, the second wiper blade 13, and the ink absorbing members 16 are in a positional relationship involving a fixed interference amount I1 with respect to the nozzle surface 22. The wiper unit 10 can move relative to the nozzle surface 22 in the wiping direction, which is parallel to the nozzle surface 22. In the present exemplary embodiment, the wiper unit 10 moves relative to the fixed recording head 2. However, this should not be construed restrictively; it is also possible to adopt a form in which the recording head 2 moves relative to the fixed wiper unit, or a form in which both of them move relative to each other.

Figure 8:
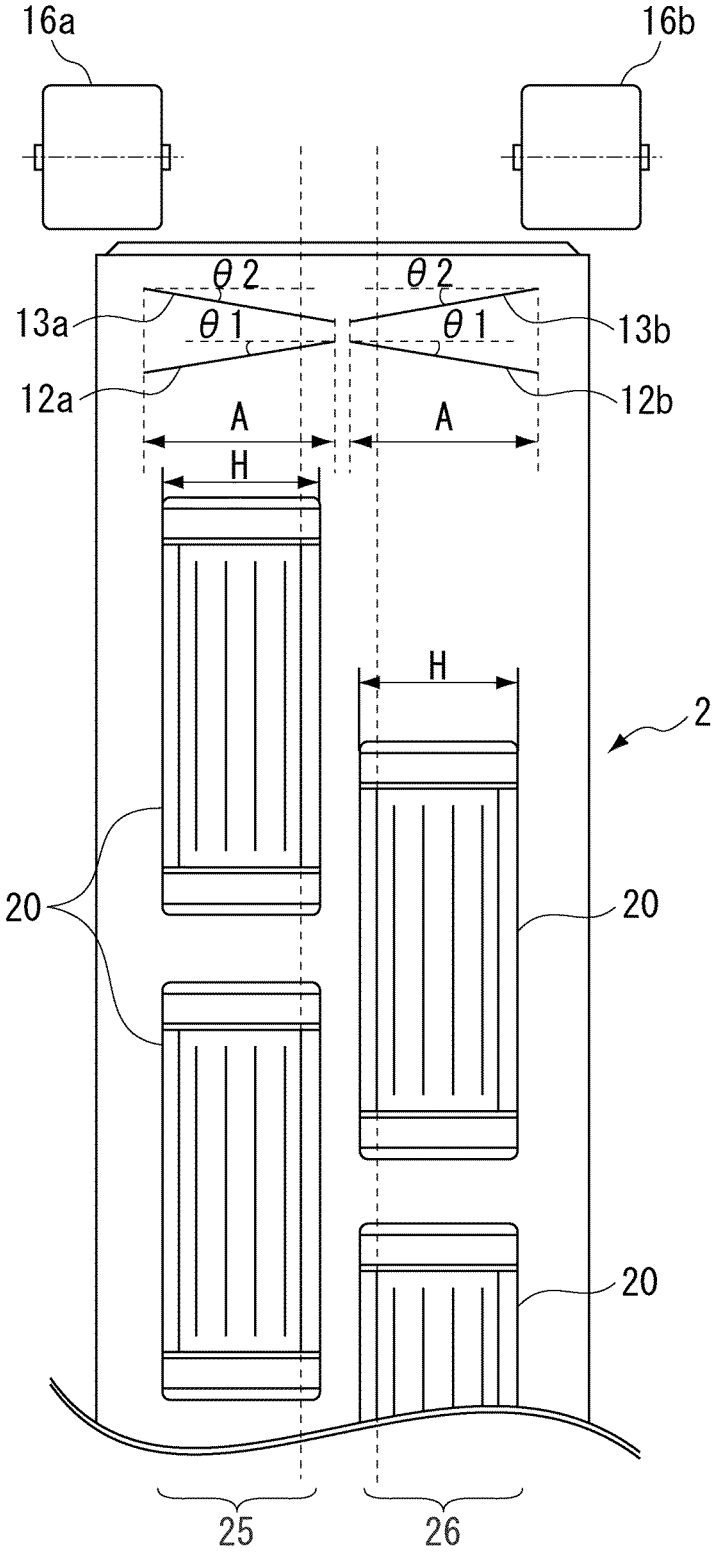
FIG. 8 illustrates the positional relationship between the recording head, wiper blades, and absorbing members.

FIG. 8 is a diagram illustrating the positional relationship between the actual recording head, wiper blades, and ink absorbing members. In the recording head 2, the nozzle chips 20 are arranged alternately, and consist of a first nozzle chip row 25 and a second nozzle chip row 26. The set (first set) consisting of the first wiper blade 12*a*, the second wiper blade 13*a*, and the ink absorbing member 16*a* is provided in correspondence with the first nozzle chip row 25. None of the components of the first set is in contact with the second nozzle chip row 26. In the first direction, both the first wiper blade 12*a* and the second wiper blade 13*a* have a width A larger than the width H of the nozzle chips 20, and entirely cover the width H. On the other hand, the set (second set) consisting of the first wiper blade 12*b*, the second wiper blade 13*b*, and the ink absorbing member 16*b* is provided in correspondence with the second nozzle chip row 26. None of the components of the second set is in contact with the first nozzle chip row 25. Both the first wiper blade 12*b* and the second wiper blade 13*b* have a wiping width corresponding to the width of a plurality of nozzle arrays. More specifically, in the first direction, both the first wiper blade 12*b* and the second wiper blade 13*b* have a width A larger than the width H of the nozzle chips 20, and entirely cover the width H. The recording head 2 is a line type recording head having a plurality of nozzle chip rows, in which a plurality of nozzle chips are arranged in the wiping direction respectively. And, the first wiper blade 12 and the second wiper blade 13 are provided for each of the nozzle chip rows.

The first wiper blade 12*a* is arranged so as to be inclined with respect to the first direction by an angle θ1. The first wiper blade 12*b* is arranged so as to be inclined with respect to the first direction by an angle −θ1. The second wiper blade 13*a* is arranged so as to be inclined with respect to the first direction by an angle θ2. The second wiper blade 12*b* is arranged so as to be inclined with respect to the first direction by an angle −θ2. Here, as seen in the drawing, the clockwise direction will be referred to as a positive direction, and the counterclockwise direction will be referred to as a negative direction.

When seen in the first direction, the ink absorbing member 16*a* partly overlaps an end portion on the outer side of the first wiper blade 12*a* and the second wiper blade 13*a*, and wipes an outer region not overlapping the nozzle chips 20. When seen in the first direction, the ink absorbing member 16*b* partly overlaps an end portion on the outer side of the first wiper blade 12*b* and the second wiper blade 13*b*, and wipes an outer region not overlapping the nozzle chips 20.

Figure 9:
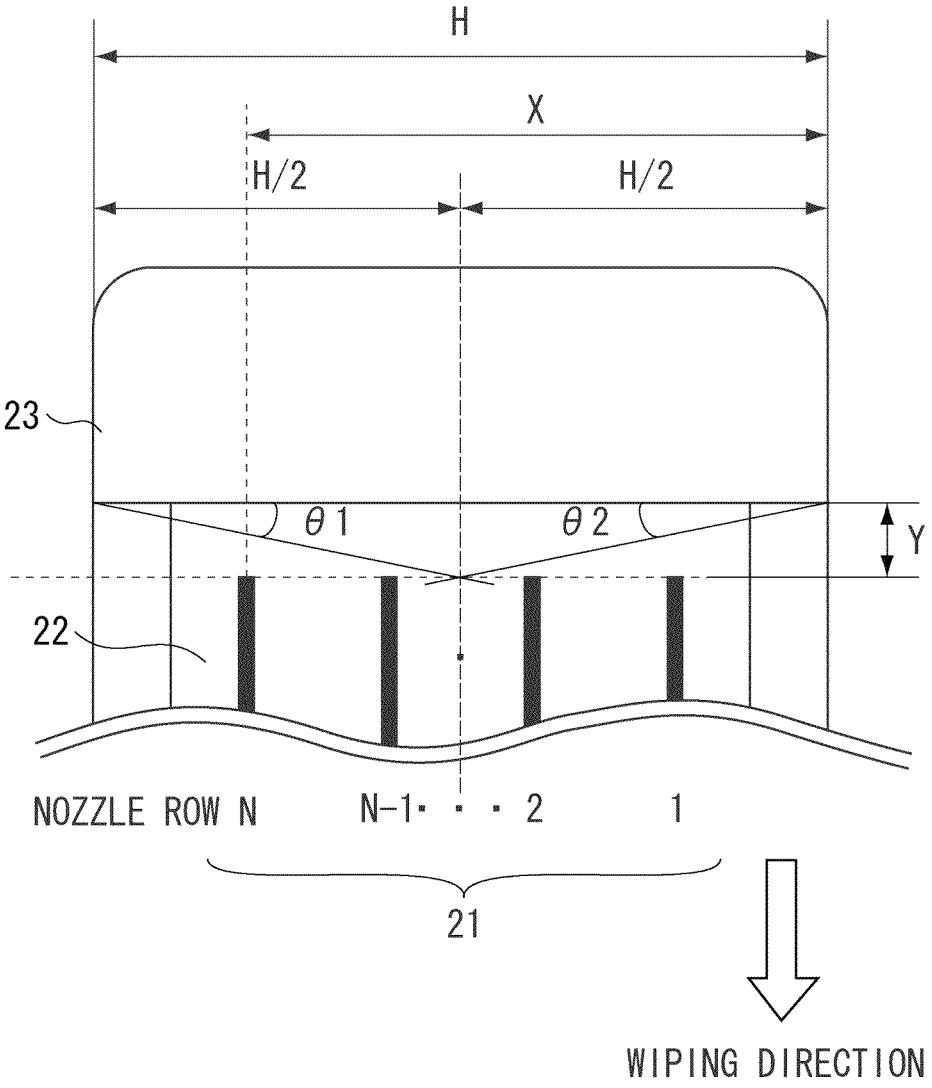
FIG. 9 illustrates the positional relationship between the components on the nozzle chip.

FIG. 9 is a diagram illustrating the positional relationship between the components on one nozzle chip. The width of the sealing portion 23 in the first direction is H. The distance from the nozzle surface side end of the sealing portion 23 to the end of the nearest nozzle array 21 in the second direction is Y. The distance from the end of the sealing portion 23 to the farthest nozzle array 21 in the first direction is X. The number of nozzle arrays 21 is N (In the present exemplary embodiment, N=4).

As described above, with respect to one nozzle chip 20, the first wiper blade 12 is arranged so as to be inclined with respect to the first direction by the angle θ1 (θ1 is positive or negative). The second wiper blade 13 is arranged so as to be inclined with respect to the first direction by the angle θ2 (θ2 is positive or negative). In this exemplary embodiment, the absolute value of the angle θ1 is equal to the absolute value of the angle θ2. However, it is not absolutely necessary for the value to be equal to each other; the absolute values may differ from each other.

More specifically, the angle θ1 satisfies the condition: $0<\theta 1<\arctan(2Y/H)$, and the angle θ2 satisfies the condition: $-\arctan(2Y/H)<\theta 2<0$. The meaning of these formulas will be described below.

FIGS. 10A through 11E are plan views illustrating the wiping operation of the wiper blades and the ink absorbing members. While in the following a description will be given of the second nozzle chip row 26 side in FIG. 13, the description also applies to the nozzle chip row 25 side, which is of a symmetrical configuration.

In one wiping operation, the set consisting of the first wiper blade 12, the second wiper blade 13, and the ink absorbing member 16 moves with respect to the surface of the nozzle chip 20 in the order: from FIG. 11A to FIG. 11E. The first wiper blade 12, the second wiper blade 13, and the ink absorbing member 16 are successively brought into contact with the nozzle surface in that order to wipe off ink and dust. When the cleaning of one nozzle chip 20 is completed, the set moves on as it is to perform a similar cleaning operation on the next nozzle chip 20. In this way, cleaning is performed on all the line heads.

Figure 10A:
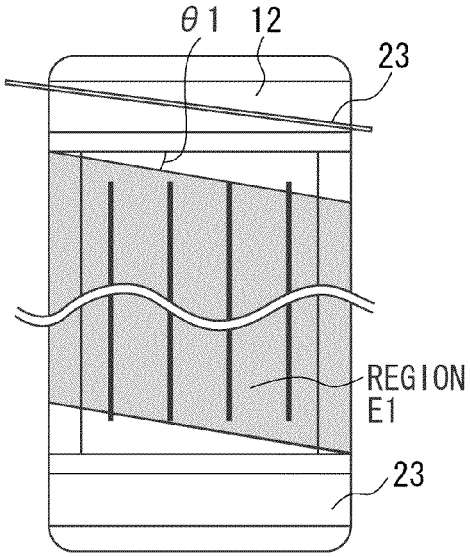
FIGS. 10A, 10B, and 10C are plan views illustrating nozzle surface regions cleaned through wiping operation.
Figure 10B:
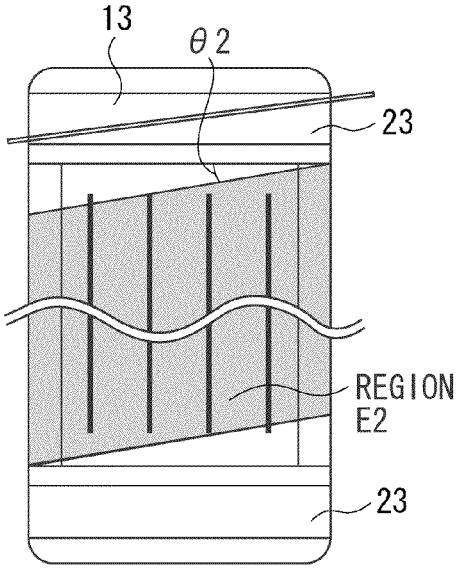
Figure 10C:
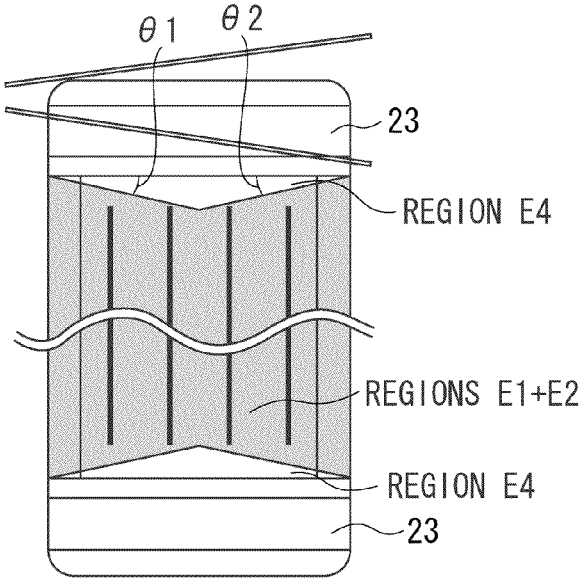
Figure 11A:
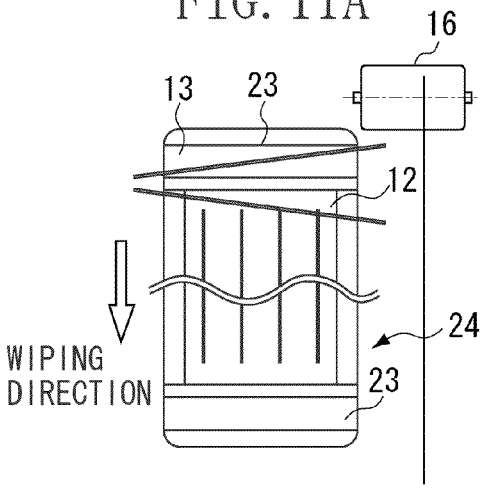
FIGS. 11A, 11B, 11C, 11D, and 11E are plan views illustrating the wiping operation.
Figure 11D:
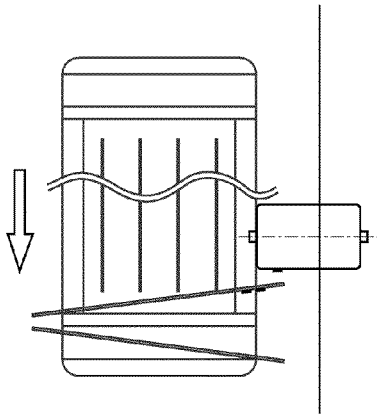
Figure 11B:
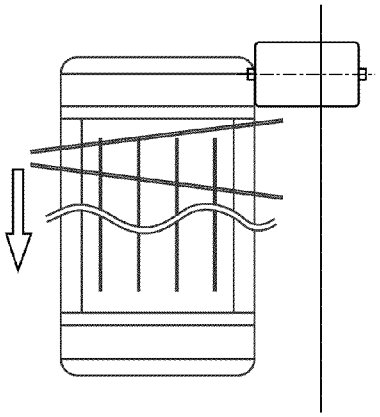
Figure 11E:
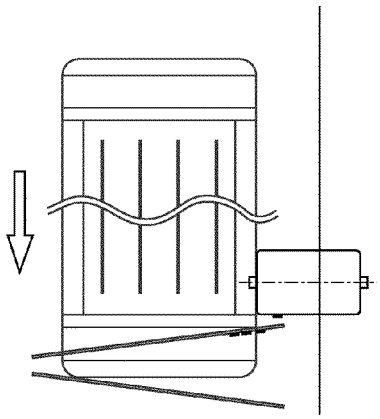
Figure 11C:
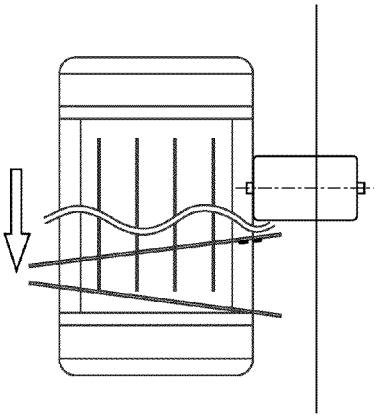

The first region reliably wiped by the first wiper blade 12 is a shaded region E1 in FIG. 10A. The next region reliably wiped by the second wiper blade 13 is a shaded region E2 in FIG. 10B. Thus, when wiping is successively performed by these two wiper blades, the total region reliably wiped is a shaded region E1+E2 in FIG. 10C. As can be seen from FIG. 10C, cleaning is performed completely on all the four nozzle arrays 21 up to the end portions.

If the angle θ1 and the angle θ2 do not satisfy the relationship as expressed by the above formulas but the absolute values of the angle θ1 and the angle θ2 become larger than arctan (2Y/H), the end portions of the central nozzle arrays (the second and third nozzle arrays in the present exemplary embodiment) get out of the shaded regions E1 and E2 and remain unwiped. When the arrangement number N of a nozzle array 21 is an odd number, the central nozzle array is the ((N+1)/2)th nozzle array.

Also regarding a region E4 (the nozzle surface region other than the region E1+E2), it can happen that the wiper blades are brought into contact therewith owing to deflection caused by elastic deformation, so that wiping can be expected to occur to some degree if not so reliably as in the case of the region E1+E2.

Suppose there is only one of the first wiper blade 12 and the second wiper blade 13. In the examples shown in FIGS. 10A and 10B, the end portion of the outermost nozzle array where movement is delayed gets out of the shaded regions E1 and E2 to remain unwiped. If the forward portion of the moving wiper blade climbs onto the sealing portion 23 protruding from the nozzle surface, the entire wiper is also raised. As a result, there remains an unwiped portion in a nozzle array. The farther a nozzle array is situated, the more it is subject to this phenomenon. Further, the larger the inclination angle, the greater the influence of this phenomenon. In view of this, in the present exemplary embodiment, next to the first wiper blade 12, the second wiper blade 13 of a reverse inclination angle is caused to pass, whereby it is possible to prevent generation of an unwiped region. In other words, a region where the wiping by the first wiping blade is incomplete is wiped by the second wiper blade.

Since the first wiper blade 12 is inclined with respect to the first direction, during the wiping movement, the ink and dust scraped off by the blade are gathered on the blade surface and move toward the upstream side with respect to the wiping direction along the blade surface. More specifically, they gradually move toward the outer ink absorbing member 16. The ink and dust having overflowed from the outer side of the first wiper blade 12 as a result of the movement adhere to the base substrate 24 on the outer side of the nozzle chip 20. However, the ink and dust having overflowed and adhering to the base substrate are absorbed and recovered by the ink absorbing member 16 coming and passing afterward. As a result, cleaning is performed on the entire recording head 2 without leaving any region unwiped. Since the ink absorbing member 16 does not come into contact with the nozzle surface, no ink or dust is allowed to adhere to the nozzle surface again.

Following the first wiper blade 12, the second wiper blade 13 passes, which also scrapes off the ink. However, most of the ink has already been wiped off by the first wiper blade 12, so that only a slight amount of ink gathers on the blade surface of the second wiper blade 13. Thus, virtually no ink overflows from the end portion (the inner side) of the second wiper blade 13 to adhere to the base substrate 24.

In the present exemplary embodiment described above, both the first wiper blade 12 and the second wiper blade 13 have a wiping width large enough to cover a plurality of nozzle arrays. However, if it is possible for the region E1+E2 shown in FIG. 10C to cover all the nozzle arrays up to the end portions, one or both of the first wiper blade 12 and the second wiper blade 13 may have a small wiping width which does not cover the width of a plurality of nozzle arrays.

Figure 12A:
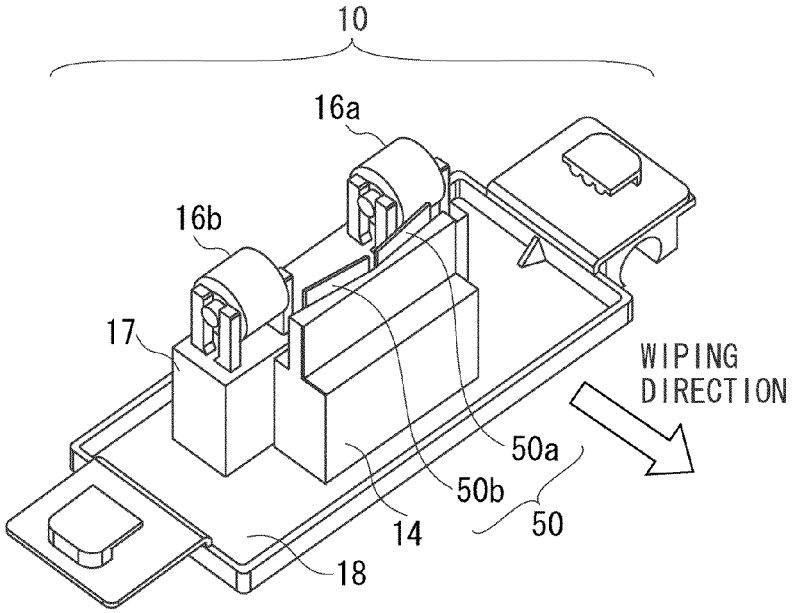
FIGS. 12A and 12B illustrate the construction of a wiper unit according to a second exemplary embodiment of the present invention.
Figure 12B:
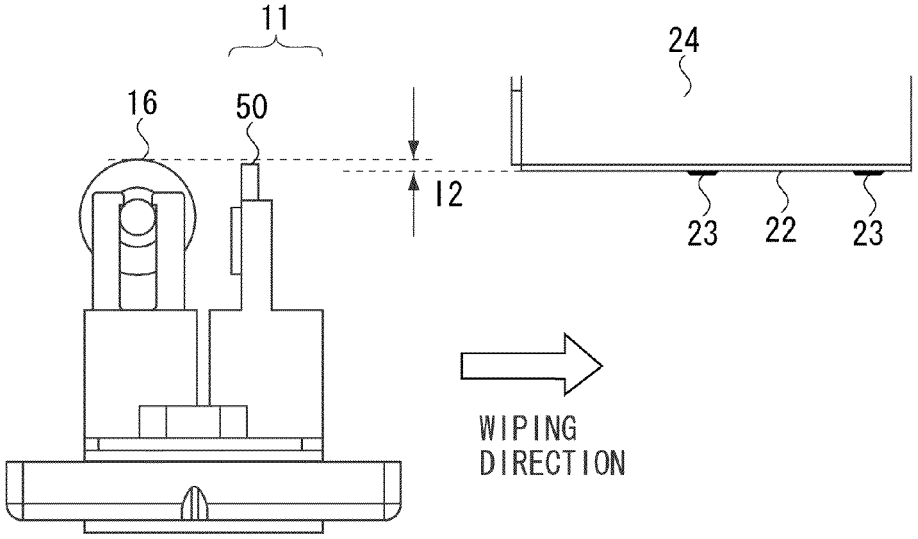

FIGS. 12A and 12B illustrate the construction of a wiper unit according to a second exemplary embodiment. This exemplary embodiment differs from the above-described one in the number and configuration of wiper blades. Otherwise, it is of the same construction as the above exemplary embodiment, so the following description will focus on the differences.

In the present exemplary embodiment, two wiper blades (50*a* and 50*b*) are provided. The positional relationship between the wiper blades 50 and the ink absorbing members 16 is such that there is an interference amount of I2 with respect to the nozzle surface 22.

Figure 13:
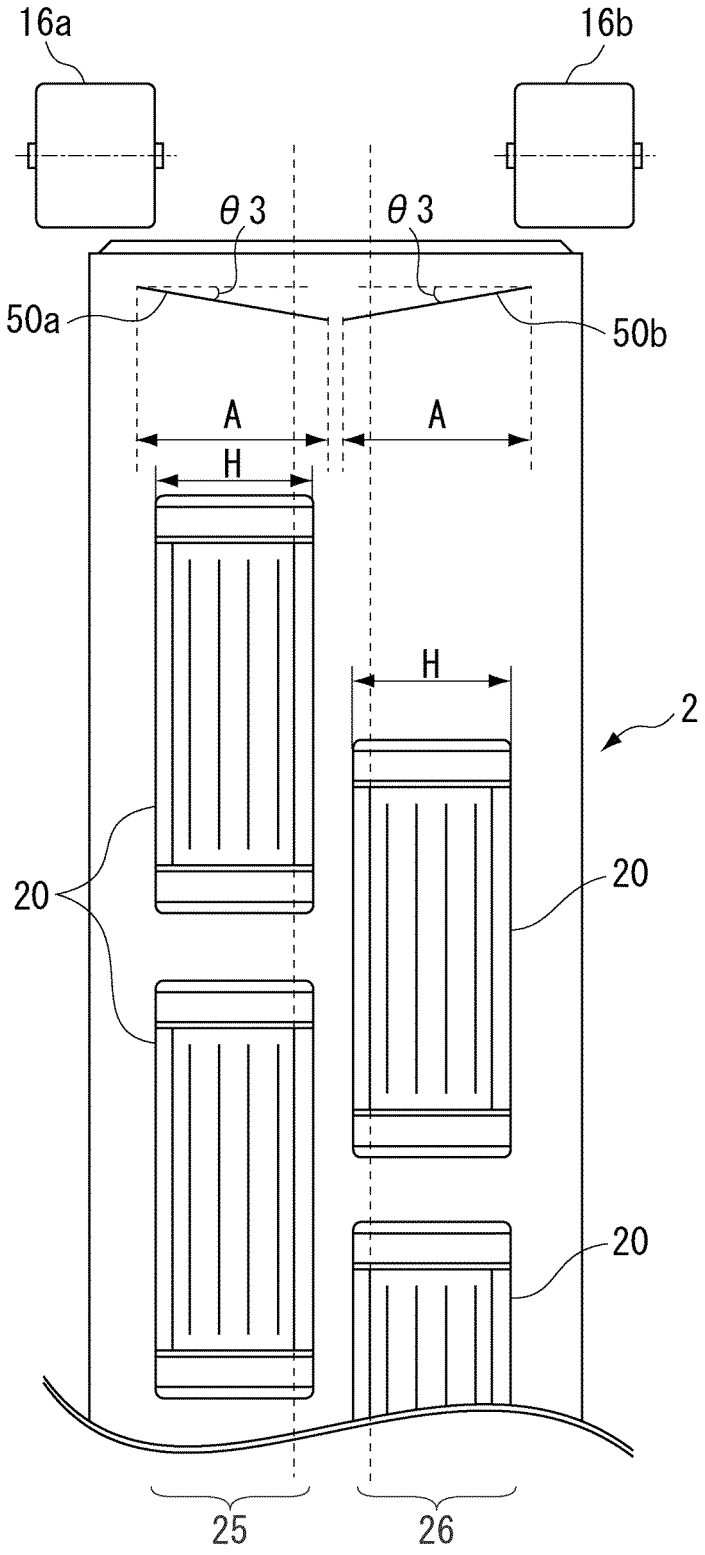
FIG. 13 illustrates the positional relationship between a recording head, wiper blades, and absorbing members.

FIG. 13 illustrates the positional relationship between the actual recording head, wiper blades, and ink absorbing members. A set (first set) consisting of the wiper blade 50*a* and the ink absorbing member 16*a* is provided in correspondence with a first nozzle chip row 25, and none of the components of the first set comes into contact with a second nozzle chip row 26. In the first direction, the wiper blade 50*a* has a width A which is larger than the width H of the nozzle chip 20, and is in a positional relationship that covers the entire width H. On the other hand, a set (second set) consisting of the wiper blade 50*b* and the ink absorbing member 16*b* is provided in correspondence with the second nozzle chip row 26; none of the components of the second set comes into contact with the first nozzle chip row 25. In the first direction, the wiper blade 50*b* has a width A which is larger than the width H of the nozzle chip 20, and is in a positional relationship that covers the entire width H.

The wiper blade 50*a* is arranged so as to be inclined with respect to the first direction by an angle θ3. The wiper blade 50*b* is arranged so as to be inclined with respect to the first direction by an angle −θ3. As seen in the first direction, the ink absorbing members 16 partly overlap end portions on the outer sides of the wiper blades 50, and wipe the outer regions not overlapping the nozzle chips 20.

In the present exemplary embodiment, wiping is performed on the nozzle chips not with two wiper blades as in the above-described exemplary embodiment but with one wiper blade. Thus, there is a possibility of generating an unwiped region as described above. However, as described below, the range of the inclination angle θ3 is determined appropriately, whereby no region remains unwiped.

Figure 14:
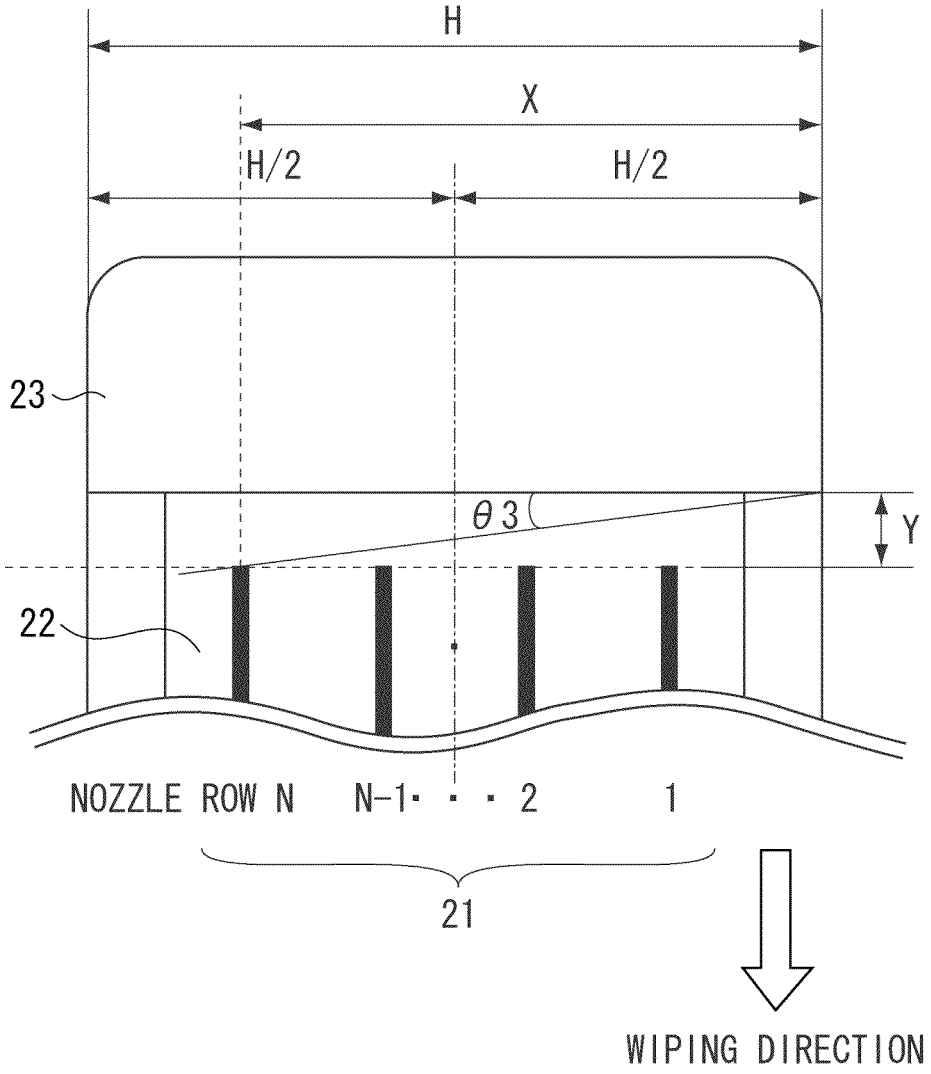
FIG. 14 is a plan view illustrating a nozzle surface region cleaned through wiping operation.

FIG. 14 is identical with FIG. 9 except for the angle θ3. In this example, the second nozzle chip row 26 side of FIG. 13 is shown. The angle θ3 is the inclination angle of the wiper blade 50*b*. The angle θ3 satisfies the relationship: $(-\arctan(Y/X))<\theta 3<0$. Regarding the other wiper blade 50*a*, symmetrically arranged, the angle θ3 satisfies the relationship: $0<\theta 3<\arctan(Y/X)$. More specifically, in any direction of inclination, the absolute value of the angle θ3 satisfies the relationship: $0<\theta 3<\arctan(Y/X)$.

Figure 15:
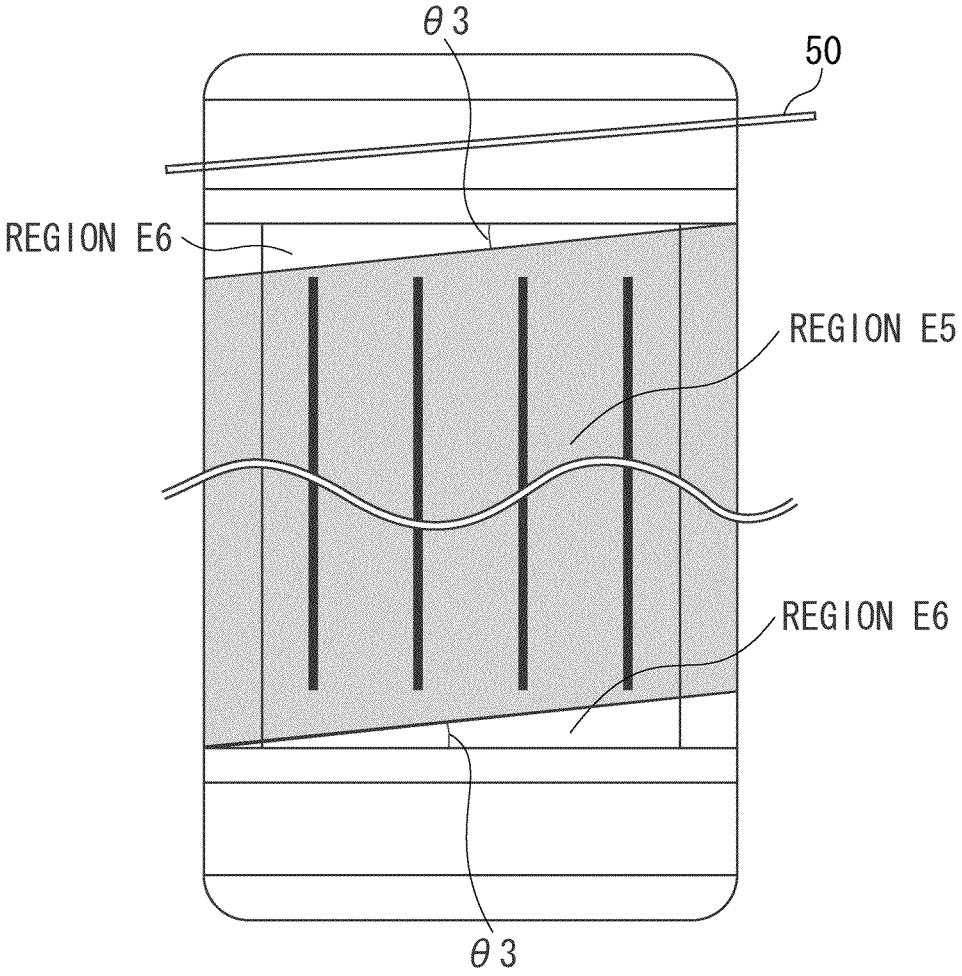
FIG. 15 illustrates the positional relationship between the components on a nozzle chip.

In FIG. 15, the region reliably wiped by the wiper blades 50 is a shaded region E5. When the angle θ3 satisfies the above formula, all the nozzle arrays are enclosed in the region E5, and no defective wiping occurs. If the absolute value of the angle θ3 becomes larger than arctan(Y/X), it is highly possible that the upper end portion of the nozzle array 21 farthest from the end of the sealing portion 23 is left unwiped when the wiper blade 50 is raised at the sealing portion 23.

Also regarding a region E6 (the nozzle surface region other than the region E5), it is possible that the wiper blade is brought into contact therewith owing to deflection caused by elastic deformation, so that wiping can be expected to occur to some degree if not so reliably as in the case of the region E5.

Since the wiper blade 50 is inclined with respect to the first direction, during the wiping movement, the ink and dust scraped off by the blade are gathered on the blade surface and gradually move toward the outer ink absorbing member 16 along the blade surface. The ink having overflowed and adhering to the base substrate 24 is absorbed and recovered by the ink absorbing member 16 coming and passing afterward. As a result, cleaning is performed on the entire recording head 2 without leaving any region unwiped. Since the ink absorbing member 16 does not come into contact with the nozzle surface, no ink or dust is allowed to adhere to the nozzle surface again.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-257419 filed Nov. 10, 2009, which is hereby incorporated by reference herein in its entirety.

What is claimed is:

1. An apparatus comprising:

a recording head having an area in which a plurality of nozzle arrays is arranged, and sealing portions arranged at end portions of the area and protruding from the area; and a wiper unit capable of relatively moving with respect to the area in a wiping direction parallel to the area and configured to wipe the area, wherein the wiper unit has a first wiper blade and a second wiper blade, the first wiper blade is arranged to be inclined by an angle θ1 (θ1>0) with respect to a direction orthogonal to the wiping direction within a plane parallel to the area, while the second wiper blade is provided so that wiping of the same nozzle array by the first wiper blade is followed by wiping of the same nozzle array by the second wiper blade and is arranged to be inclined by an angle θ2 (θ2<0) with respect to the direction orthogonal to the wiping direction within the plane.

2. The apparatus according to claim 1, wherein, a width of the sealing portion in a direction orthogonal to the wiping direction is H, and that a distance in the wiping direction from an end of the sealing portion to an end of the nozzle arrays is Y, the angle θ1 satisfies the condition: $0<\theta 1<\arctan(2Y/H)$, and the angle θ2 satisfies the condition: $-\arctan(2Y/H)<\theta 2<0$.

3. The apparatus according to claim 1, wherein the first wiper blade and the second wiper blade have a wiping width corresponding to the width of the plurality of nozzle arrays.

4. The apparatus according to claim 1, wherein the absolute value of the angle θ1 and the absolute value of the angle θ2 are equal.

5. The apparatus according to claim 1, wherein a region where wiping by the first wiper blade is incomplete is wiped by the second wiper blade.

6. The apparatus according to claim 1, further comprising an ink absorbing member moving with the first wiper blade, wherein ink overflowing from an end of the first wiper blade as a result of the movement is absorbed by the ink absorbing member.

7. The apparatus according to claim 1, wherein the recording head is a line type recording head.

8. The apparatus according to claim 7, wherein, on the line type recording head, there are arranged on a base substrate and in the wiping direction a plurality of nozzle chips having the nozzle surface, and the sealing portion is formed in correspondence with each of the nozzle chips.

9. The apparatus according to claim 8, wherein the sealing portion is provided at two positions in the vicinity of both ends of the nozzle surface with respect to the direction in which the nozzle arrays are formed.

10. The apparatus according to claim 8, wherein the line type recording head has a plurality of nozzle chip rows with a plurality of nozzle chips arranged in the wiping direction, and the wiper blade is provided for each of the nozzle chip rows.

11. An apparatus comprising:

a recording head having an area in which a plurality of nozzle arrays is arranged, and sealing portions arranged at end portions of the area and protruding from the area;

a first wiper blade capable of relatively moving with respect to the area in a wiping direction parallel to the area and configured to wipe the area, the first wiper blade is arranged to be inclined by an angle θ1 (θ1>0) with respect to a direction orthogonal to the wiping direction within a plane parallel to the area; and a second wiper blade capable of relatively moving with respect to the area in the wiping direction parallel to the area and configured to wipe the area, wherein the second wiper blade is provided so that wiping of the same nozzle array by the first wiper blade is followed by wiping of the same nozzle array by the second wiper blade and is arranged to be inclined by an angle θ2 (θ2<0) with respect to the direction orthogonal to the wiping direction within the plane.

12. The apparatus according to claim 11, wherein, a width of the sealing portion in a direction orthogonal to the wiping direction is H, and that a distance in the wiping direction from an end of the sealing portion to an end of the nozzle arrays is Y, the angle θ1 satisfies the condition: $0<\theta 1<\arctan(2Y/H)$, and the angle θ2 satisfies the condition: $-\arctan(2Y/H)<\theta 2<0$.

13. The apparatus according to claim 11, wherein the first wiper blade and the second wiper blade have a wiping width corresponding to the width of the plurality of nozzle arrays.

14. The apparatus according to claim 11, wherein the absolute value of the angle θ1 and the absolute value of the angle θ2 are equal.

15. The apparatus according to claim 11, wherein a region where wiping by the first wiper blade is incomplete is wiped by the second wiper blade.

16. The apparatus according to claim 11, further comprising an ink absorbing member moving with the first wiper blade, wherein ink overflowing from an end of the first wiper blade as a result of the movement is absorbed by the ink absorbing member.

17. The apparatus according to claim 11, wherein the recording head is a line type recording head.

18. The apparatus according to claim 17, wherein, on the line type recording head, there are arranged on a base substrate and in the wiping direction a plurality of nozzle chips having the nozzle surface, and the sealing portion is formed in correspondence with each of the nozzle chips.

19. The apparatus according to claim 18, wherein the sealing portion is provided at two positions in the vicinity of both ends of the nozzle surface with respect to the direction in which the nozzle arrays are formed.

20. The apparatus according to claim 18, wherein the line type recording head has a plurality of nozzle chip rows with a plurality of nozzle chips arranged in the wiping direction, and the wiper blade is provided for each of the nozzle chip rows.

21. An apparatus comprising:

a recording head having an area in which a plurality of nozzle arrays is arranged, and sealing portions arranged at an end portions of the area and protruding from the area;

a first wiper blade capable of relatively moving with respect to the area in a wiping direction parallel to the area and configured to wipe the area, the first wiper blade is arrange to be inclined by an angle θ1(θ1>0) with respect to a direction orthogonal to the wiping direction within a plane parallel to the area; and a second wiper blade capable relatively moving with respect to the area in the wiping direction and configured to wipe the area, wherein the second wiper blade is provided so that wiping of the same nozzle array by the first wiper blade is followed by wiping of the same nozzle array by the second wiper blade and is arranged to be inclined by an angle θ2(θ2<0) with respect to the direction orthogonal to the wiping direction within the plane.

22. The apparatus according to claim 21, wherein, a width of the sealing portion in a direction orthogonal to the wiping direction is H, and that a distance in the wiping direction from an end of the sealing portion to an end of the nozzle arrays is Y, the angle θ1 satisfies the condition: $0<\theta 1<\arctan(2Y/H)$, and the angle θ2 satisfies the condition: $-\arctan(2Y/H)<\theta 2<0$.

23. The apparatus according to claim 21, wherein the first wiper blade and the second wiper blade have a wiping width corresponding to the width of the plurality of nozzle arrays.

24. The apparatus according to claim 21, wherein the absolute value of the angle θ1 and the absolute value of the angle θ2 are equal.

* * * * *